US007734208B2

(12) United States Patent
Seo et al.

(10) Patent No.: US 7,734,208 B2
(45) Date of Patent: Jun. 8, 2010

(54) IMAGE FIXING APPARATUS AND IMAGE FORMING APPARATUS CAPABLE OF EFFECTIVELY CONTROLLING AN IMAGE FIXING TEMPERATURE

(75) Inventors: Hiroshi Seo, Yokohama (JP); Tadashi Ogawa, Machida (JP); Motokazu Yasui, Yokohama (JP); Hiroshi Koide, Yamato (JP)

(73) Assignee: Ricoh Company, Ltd., Tokyo (JP)

( * ) Notice: Subject to any disclaimer, the term of this patent is extended or adjusted under 35 U.S.C. 154(b) by 939 days.

(21) Appl. No.: 11/518,350

(22) Filed: Sep. 11, 2006

(65) Prior Publication Data

US 2007/0059011 A1 Mar. 15, 2007

(30) Foreign Application Priority Data

Sep. 9, 2005 (JP) ..... 2005-262455
Apr. 28, 2006 (JP) ..... 2006-124682

(51) Int. Cl.
*G03G 15/20* (2006.01)
*G03G 21/20* (2006.01)

(52) U.S. Cl. ..... 399/69; 399/67; 399/94; 399/335

(58) Field of Classification Search ..... 399/69, 399/67, 70, 94, 335
See application file for complete search history.

(56) References Cited

U.S. PATENT DOCUMENTS 5,681,494 A * 10/1997 Suzuki et al. ..... 219/497
2005/0201768 A1* 9/2005 Tatematsu et al. ..... 399/69

FOREIGN PATENT DOCUMENTS

| | | |
|---|---|---|
| JP | 56-069675 | 6/1981 |
| JP | 09-152805 | 6/1997 |
| JP | 2003-167605 | 6/2003 |
| JP | 2004-233543 | 8/2004 |
| JP | 2005-012685 | 1/2005 |

OTHER PUBLICATIONS

Machine translation of reference Shirai (JP2004-233543, Listed in IDS).*
Machine translation of reference Minamino (JP2003-167605, Listed in IDS).*

* cited by examiner

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

An image fixing apparatus controls temperature of a rotating member for fixing with compensation for delay by using a Smith predictor with a controlled object model to reduce temperature ripple effectively. In one example, the image fixing apparatus includes a pair of rotating members to form a nip portion, a heater to heat the rotating member, a temperature sensor to detect temperature of the rotating member, a calculator to calculate a heat value to attain a target temperature of the rotating member, a controller to control the heater based on a calculation result of the heat value with compensation for delay using a model according to the calculation result, and a selector to select a control in which an output of the compensation is input into the calculator or a control in which the output of the compensation is not input into the calculator.

15 Claims, 11 Drawing Sheets

IMAGE FIXING APPARATUS AND IMAGE FORMING APPARATUS CAPABLE OF EFFECTIVELY CONTROLLING AN IMAGE FIXING TEMPERATURE

BACKGROUND OF THE INVENTION

1. Field of the Invention

The present invention generally relates to an image fixing apparatus and an image forming apparatus equipped with the fixing apparatus, and more particularly to an image fixing apparatus capable of fixing a toner image onto a recording medium by effectively controlling an image fixing temperature in an electrophotographic process.

2. Discussion of the Background

A background image forming apparatus such as a printer, a copying machine, and a facsimile using an electrophotographic method is generally provided with an image fixing apparatus that melts and fixes a toner image onto a recording medium with heat. This heating type image fixing apparatus commonly includes a heater, a fixing member, and a rotating member. The heater is energized with power to produce heat. The fixing member is heated up to a target temperature by the heater. The rotating member is arranged in contact with the fixing member to form a nip region therebetween. Since the heater keeps the nip region at the target temperature, a recording medium carrying a toner layer thereon undergoes an image fixing process as it passes through the nip region.

Stably maintaining the target temperature is a key element of good quality image formation. If the temperature is higher or lower than the target, a poor image, referred to as an offset image, may be formed or poor fixing may occur. Furthermore, reducing a warm-up period of the image fixing apparatus is also needed for shortening a waiting time.

One exemplary attempt to shorten the warm-up time is to reduce a heat capacity of the fixing member. This attempt produces a high heat nip between the fixing member, in a form of a thin film having a relatively low heat capacity, and the rotating member, while achieving a reduction of warm-up time. This attempt also achieves a successful use of a belt-shaped fixing member. In this case, the fixing belt is extended between two or more rollers including a first roller having a relatively low thermal conductivity and a second roller serving as a heat source. The first roller closely faces a third roller via the fixing belt to form a nip with the fixing belt.

In addition to these low heat capacity examples, the fixing member having a low heat capacity may be provided with an alternative heat source, that is, an induction heater for directly heating the fixing member.

The above techniques, however, require a high accuracy in controlling temperature of the fixing member due to its low heat capacity.

Controlling electric power to the heater controls temperature of the fixing member. For controlling electric power, temperature sensors are provided in the fixing apparatus such as a thermo pile and a thermo sensitive register to detect a temperature of the fixing member. When the detected temperature is lower than the target temperature, the heater is turned on. When the detected temperature is higher than the target temperature, the heater is turned off. This is called an ON-OFF controlling method.

Although the ON-OFF controlling is used in this method, carrying out precise temperature control may be difficult due to a temperature ripple.

A temperature ripple induces to use a compensation in which a calculator calculates an amount of operations and outputs the amount to a controlled object based on the desired temperature value and the amount of feedbacks. For example, the amount of proportional integral (PI) or proportional integral differential (PID) operations is calculated as the compensation.

Even if the control method with the compensation is used, an exothermic delay in the heater, a heat transmission delay from the heater to a fixing member surface, a detecting delay from a slow response of a temperature sensor, and a delay from a heater driver to the temperature sensor may occur. They may cause a temperature ripple. Furthermore, the temperature ripple may easily occur in a belt fixing apparatus, because the heat delay in the belt is greater.

For reducing the temperature ripple, two or more output patterns of a specific pulse corresponding to a detected temperature may be stored and one of the control patterns may be selected according to the detected temperature to carry out the temperature control. As another method, calculating the change rate of difference between the last control timing temperature and the present detected temperature is used for predicting the next control timing temperature to control the temperature. The number of the specific pulses or the width of the specific pulse is used for the control.

SUMMARY OF THE INVENTION

The present invention provides a novel image fixing apparatus that controls temperature of a rotating member for fixing with compensation for delay by using a Smith predictor with a controlled object model to reduce temperature ripple effectively. In one example, the image fixing apparatus includes a pair of rotating members to form a nip region, a heater to heat the rotating member, a temperature sensor to detect temperature of the rotating member, a calculator to calculate heat value to attain a target temperature of the rotating member, a controller to control the heater based on a calculated result of the heat value with compensation for delay using a model according to the calculated result, and a selector to select a control such that an output of the compensation is input into the calculator or a control such that the output of the compensation is not input into the calculator.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
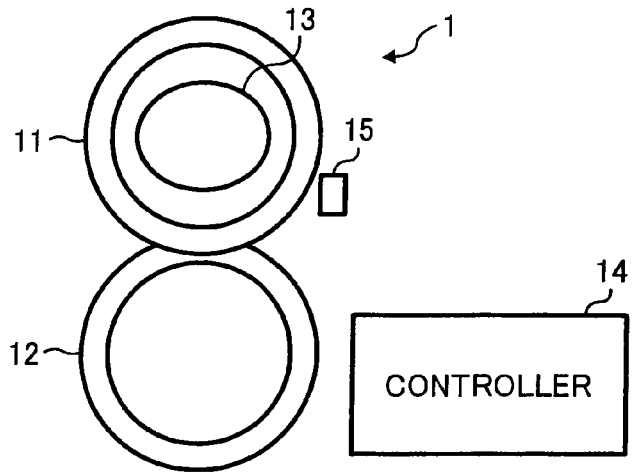
FIG. 1 is an illustration illustrating an exemplary configuration of an image fixing apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image fixing apparatus 1 according to an exemplary embodiment of the present invention is explained.

The image fixing apparatus 1 of FIG. 1 is for use in an electrophotographic image forming apparatus such as a laser printer, a digital copier, a facsimile machine, a printer-fax-copy multifunction machine, etc. This image fixing apparatus 1 uses a roller fixing system. As illustrated in FIG. 1, the fixing apparatus 1 includes rotating members 11 and 12, a heater 13, a controller 14, and a temperature sensor 15. The rotating member 11 includes the heater 13 such as a halogen lamp heater, IH heater, etc. A toner image unfixedly held on a recording medium (e.g., a paper sheet) is pressed and heated in a nip press region formed between the rotating members 11 and 12, and is fixed on the recording medium. The temperature sensor 15 such as a thermo pile or a thermo sensitive register detects the temperature of the rotating member 11. The controller 14 control the temperature, driving the heater 13 based on the detected temperature.

Figure 2:
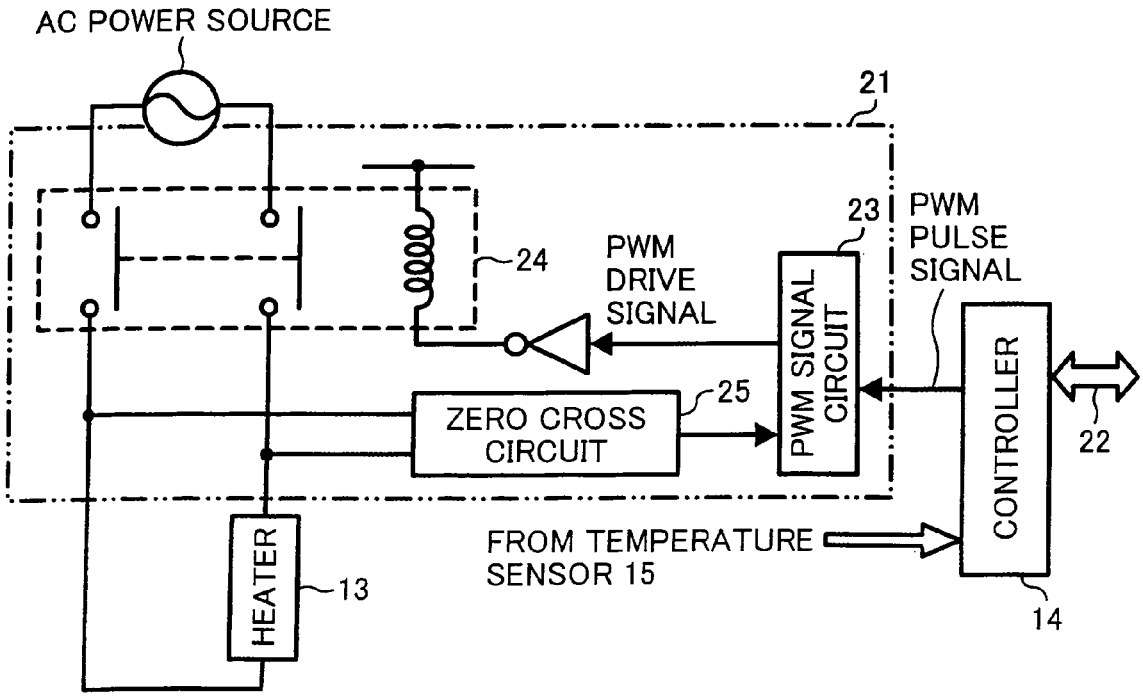
FIG. 2 is an illustration of a circuit diagram illustrating a PWM drive circuit connected to a controller of the image fixing apparatus of FIG. 1.

FIG. 2 is an illustration of a circuit diagram illustrating a pulse width modulation (PWM) drive circuit 21 as a controller to perform a temperature control of the heater 13. The controller 14 communicates with an image forming apparatus 101 (see FIG. 14) through an interface 22. The controller 14 also receives a detection signal from the temperature sensor 15, and outputs a PWM pulse signal into the PWM drive circuit 21. The PWM drive circuit 21 includes a PWM drive signal generating circuit 23, a power switching circuit 24, and a zero crossing detection circuit 25. The PWM drive circuit 21 PWM-drives the heater 13.

Figure 3:
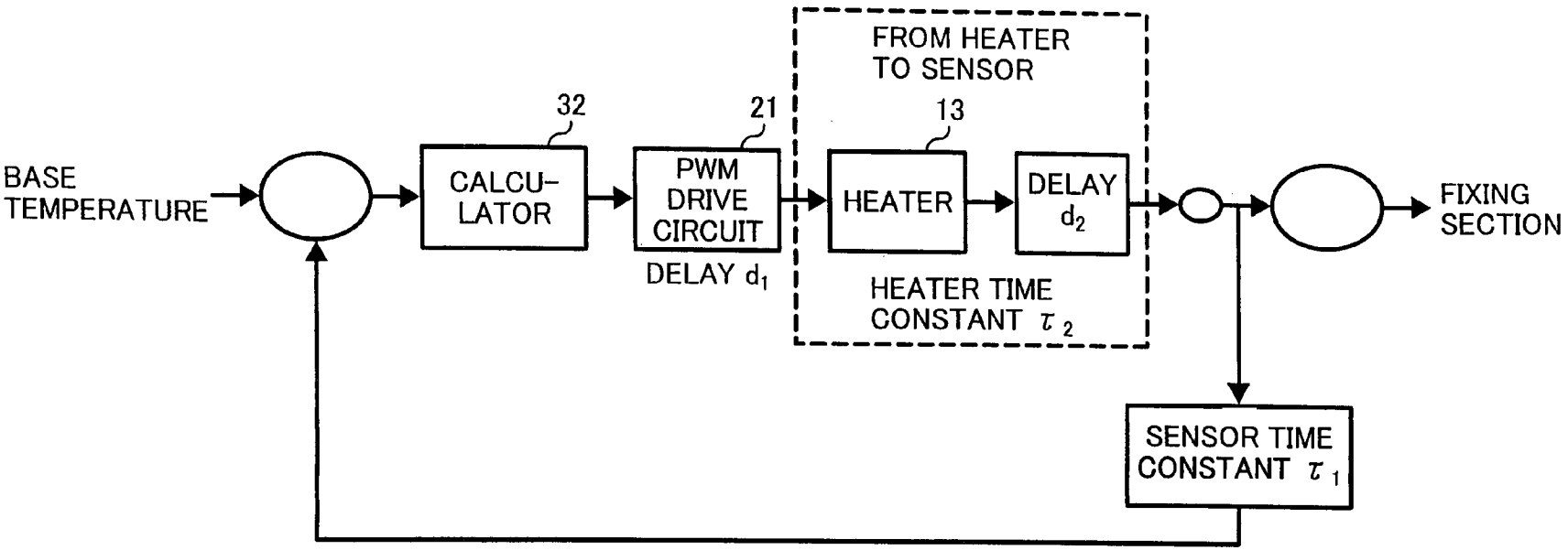
FIG. 3 is a block diagram illustrating a control system of the controller of FIG. 2.

FIG. 3 is a block diagram of the control system of FIG. 2 in which a feedback control is carried out based on a temperature detected by the temperature sensor 15. As illustrated in FIG. 3, this control system utilizes two portions to cause a time delay considered to be a wasting time period. One time delay referred to as a delay d1 is generated in the PWM drive circuit 21 and the other time delay referred to as a delay d2 is generated in a section between the heater 13 and the sensor 15. The delay d1 is caused due to an ON-OFF controlling of the heater 13, and delay d2 is caused due to a heat transmission from the driver of the heater 13 to the detection by the temperature sensor 15. Because of these delays d1 and d2, this control system may produce a temperature ripple. When the output of the sensor 15 becomes larger than a target temperature after heating the heater 13, the heating is stopped. The output of the sensor 15 does not, however, decline by the period of the delay even if the heating is stopped. This may cause the temperature ripple. If a gain of the control system is lowered so that the temperature ripple by the phase delay may not occur, a control error will increase. This may cause another problem. For example, although a steady-state error is small with a PID compensation, a response may become slow. After all, when disturbances and errors occur in the control system, it takes time to reduce them.

Figure 4:
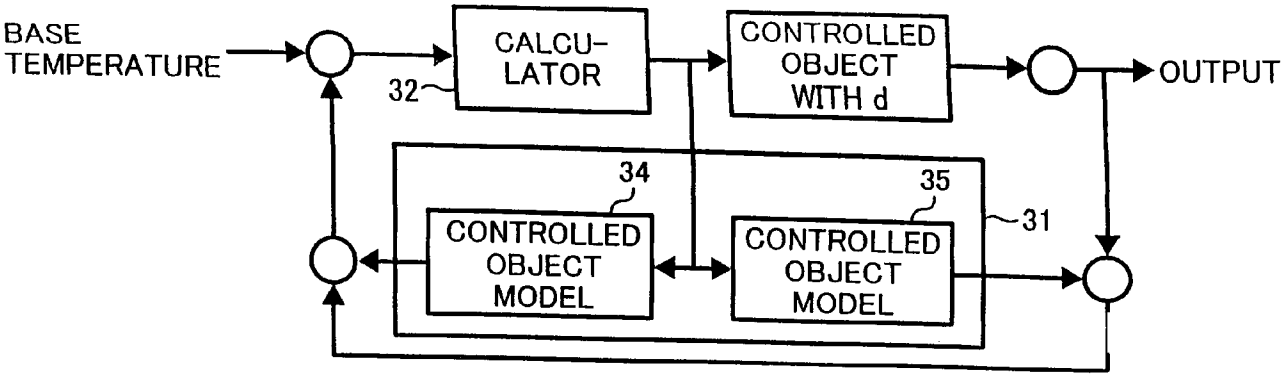
FIG. 4 is a block diagram illustrating a Smith predictor added to the control system.

To solve the above problem, a Smith predictor is used. FIG. 4 is a block diagram of the control system in which the Smith predictor is added. The Smith predictor 31 outputs a delay compensation using a model based on the result of the calculation of the amount of heating required for setting a temperature of the rotating members 11 and 12. The Smith compensating method used with the Smith predictor 31 makes the control possible assuming a controlled object without delay. The Smith predictor 31 includes a controlled object model 34 predicted according to a delay d. The Smith predictor 31 also includes a controlled object model 35. By using the Smith predictor and a calculator 32 for operating the amount of heating to set the temperature of the rotating members 11 and 12, the delay is reduced in a feedback loop of this predicting model. Thus, a parameter design of the calculator 32 may be performed to the controlled object without delay. As a result, since the control is performed to the controlled object model 34 predicted according to the delay d, the temperature ripple by the above-mentioned delay may be controlled.

Figure 5:
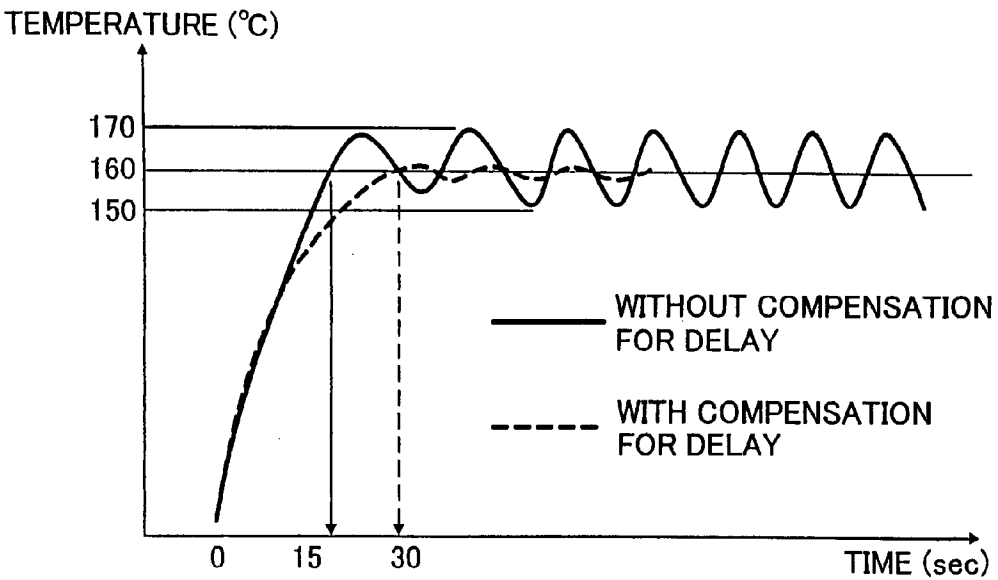
FIG. 5 is a graph showing variations of a rising temperature of a rotating member under control by the control system of FIG. 3.

FIG. 5 is a graph showing a relation of the temperature of the rotating member 11 and time. When the above control method is applied to the fixing apparatus 1, the temperature ripple is reduced at the time of continuous feeding of the paper to the image forming apparatus 101 as shown in FIG. 5. However, the temperature curve becomes gentle near a target temperature at the time of increasing temperature. This increases a waiting time for using the fixing apparatus 1.

Figure 6:
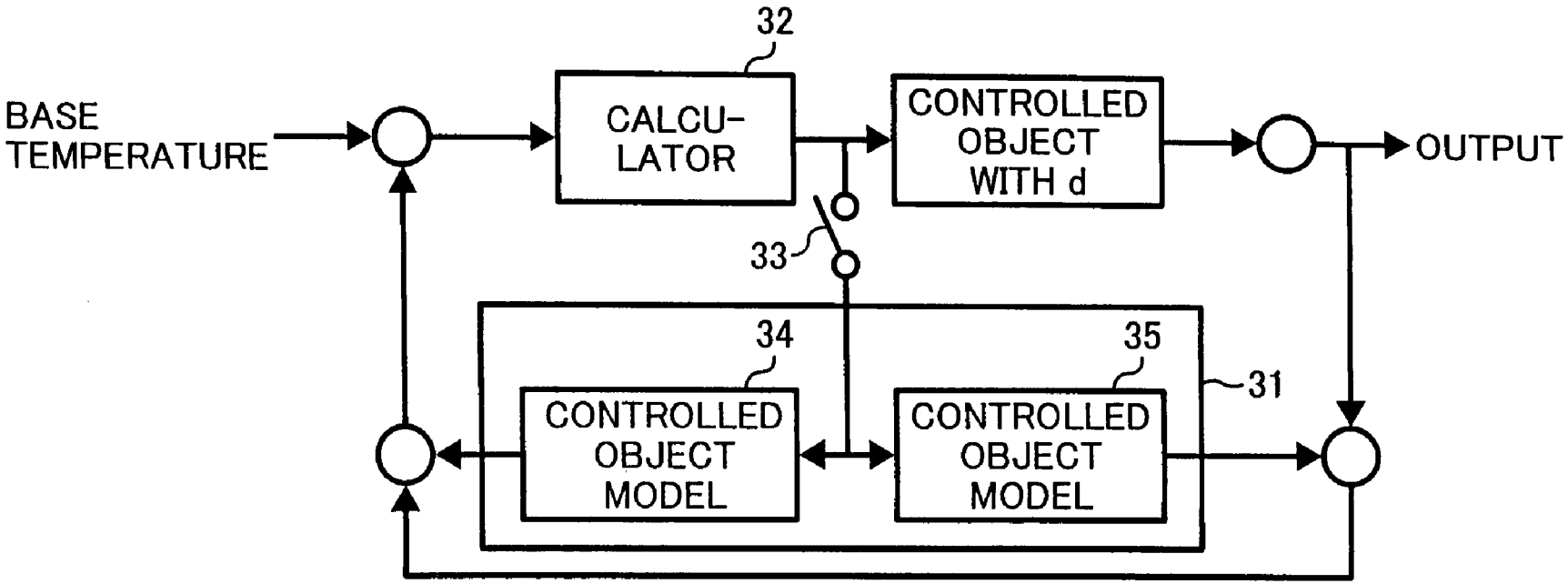
FIG. 6 is a block diagram of another control system.

FIG. 6 is a block diagram of another example of the control system in which the Smith predictor is added. This control system includes a switch 33 that selects whether to perform the compensation or not. When at least the recording medium is fed continuously in the nip part of the rotating members 11 and 12, the switch 33 selects the compensation and the delay compensation output is applied to an input side of the calculator 32 and the control is carried out.

At the time of continuous feeding of the recording medium, the temperature ripple may easily occur. The temperature ripple is caused by a transmission delay of heating from turning on the heater 13 to the transmission to the surface, a detection delay by the slow response (large time constant) of the temperature sensor 15, and the delay from the driver of the heater 13 to the temperature sensor 15.

At the time of continuous feeding of the recording medium, the switch 33 selects the compensation and the delay compensation is carried out to reduce the temperature ripple. Thereby, the image may be fixed on the recording medium with stable quality in continuous feeding of the recording medium. At the time of starting to set a temperature of the rotating members 11 and 12, the switch 33 selects no compensation and the delay compensation output is not applied to the input side of the calculator 32 and the delay compensation is not carried out.

Figure 7:
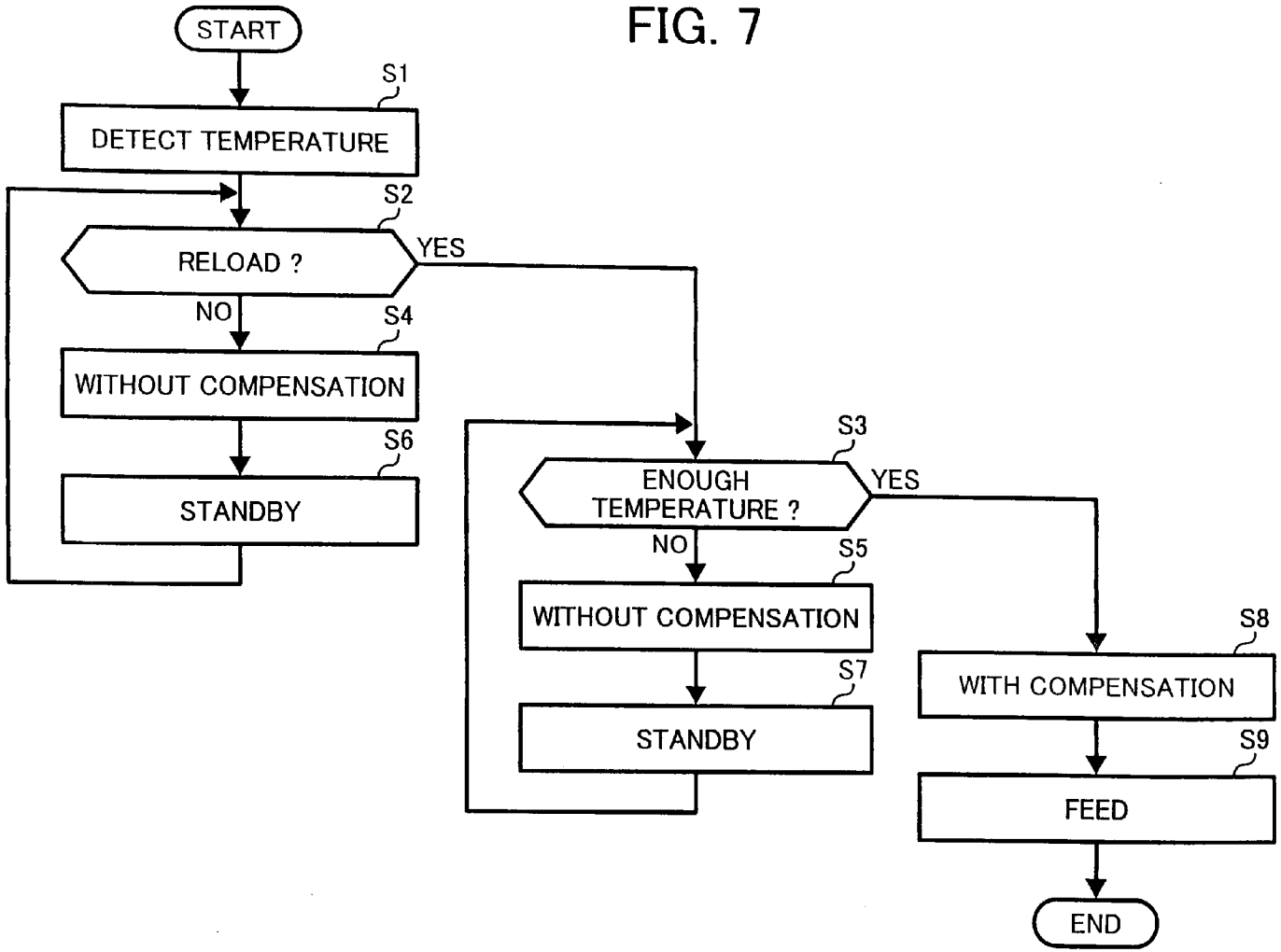
FIG. 7 illustrates a flowchart of a temperature control procedure performed by the control system of FIG. 6.

FIG. 7 illustrates a flowchart of the control system of FIG. 6. The temperature of the rotating member 11 is detected with the temperature sensor 15 (Step S1). When not reloaded, No of Step S2 is selected. When the detected temperature of the temperature sensor 15 is not satisfied for feeding to the fixing apparatus 1, No of Step S3 is selected. In steps S4 and S5, the delay compensation output is not input into the calculator 32. In steps S6 and S7, a predetermined standby time is waited for, and then the operation returns to step S3. When the detected temperature of the temperature sensor 15 is satisfied for feeding to the fixing apparatus 1, Yes of Step S3 is selected, and the delay compensation output is input into the calculator 32 (Step S8), and the recording medium is fed (Step S9).

A temperature rise time is a time from being in the so-called standby state (Steps S6 and S7) to reaching the target temperature that paper can be fed.

That is, since paper is not fed at the temperature rise, even if some temperature ripples arise, it does not effect the image quality after fixing. On the other hand, the temperature ripple will be reduced but the temperature rise time will increase if control with a delay compensation is performed.

Figure 8:
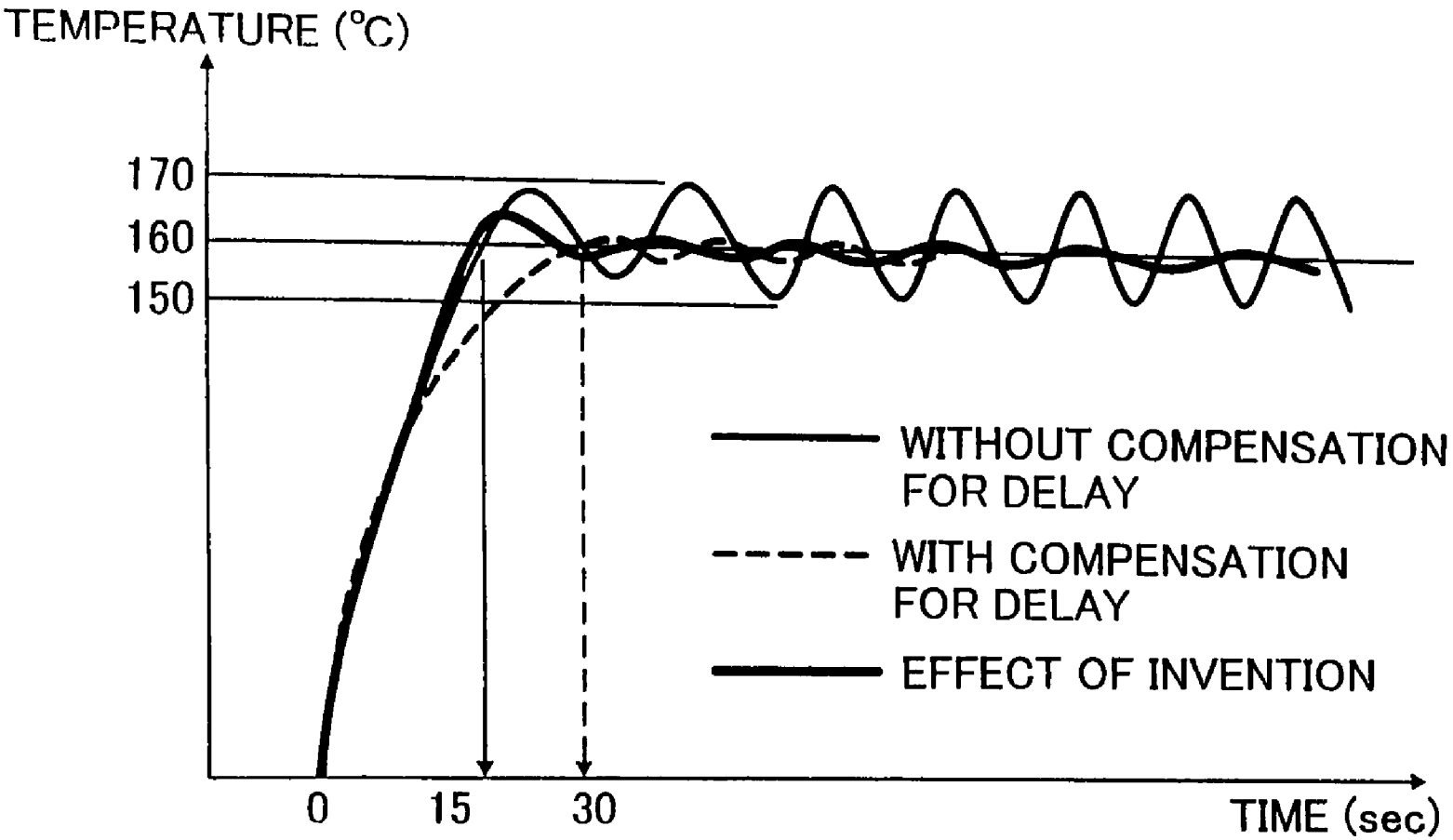
FIG. 8 is a graph showing variations of a rising temperature of the rotating member through the temperature control procedure of FIG. 7.

So, a quick rise to the target temperature at the time of a temperature rise without a control in which the delay compensation output is input into the input side of the calculator can be realized. FIG. 8 is a graph showing a relation of the temperature of the rotating member 11 and time verifying the effect of this invention. As shown from FIG. 8, the temperature rises quickly, and by the delay compensation after attaining the target temperature, the temperature rise time and the temperature ripple may be reduced. Moreover, when the target temperature is changed, the delay compensation output is not input into the input side of the calculator 32 of FIG. 6. This is applied when the target temperature is changed during the delay compensation being performed after attaining the target temperature.

Figure 9:
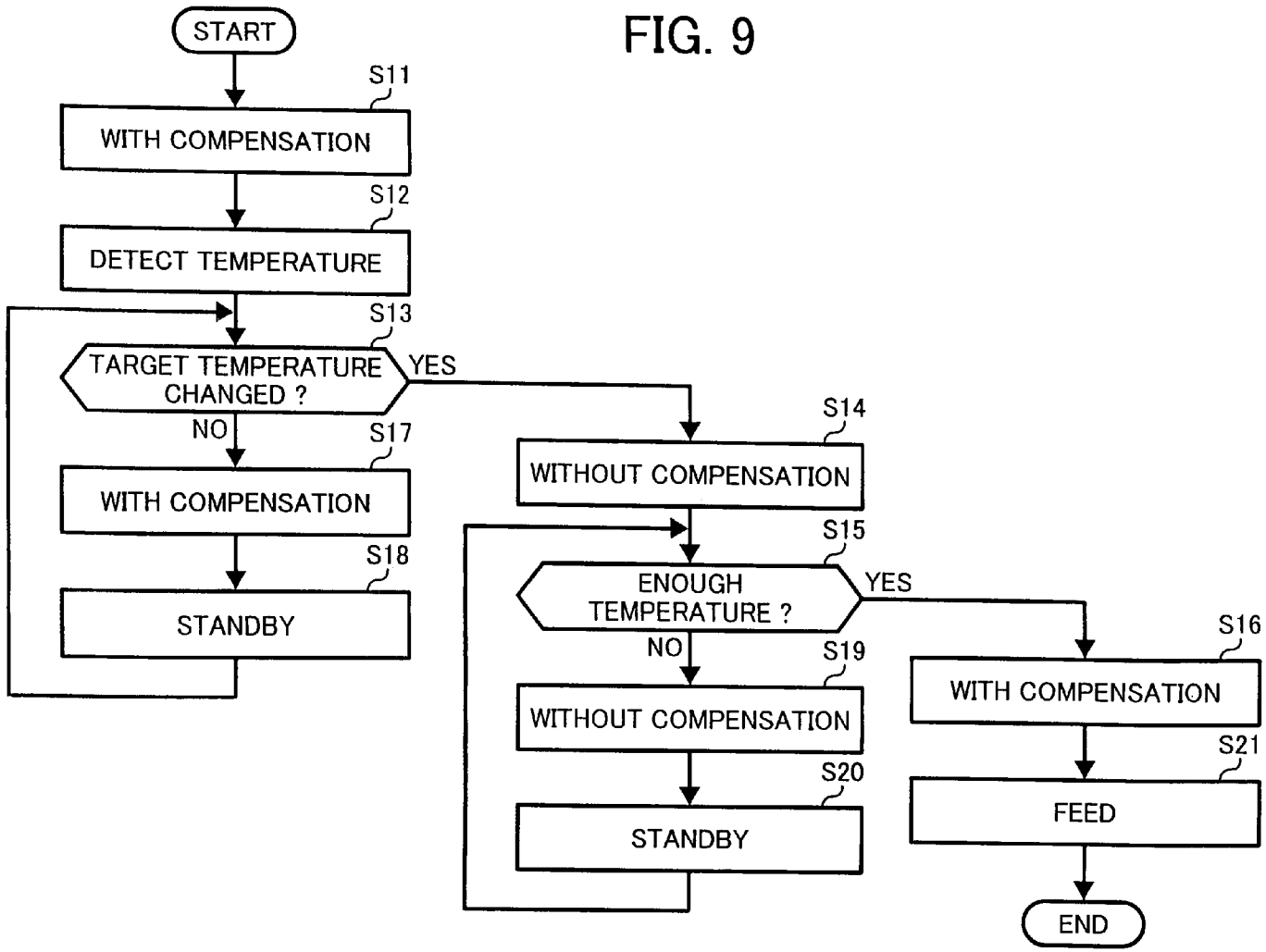
FIG. 9 illustrates a flowchart of another temperature control procedure.

FIG. 9 illustrates a flowchart of the control system of FIG. 6 when the above compensation method is applied. When the delay compensation output is input into the input side of the calculator 32 (Step S11), the temperature sensor 15 detects temperature (Step S12). When the target temperature is changed (Yes of Step S13), the delay compensation output is not input into the input side of the calculator 32 (Step S14). When the detected temperature with the temperature sensor 15 is high enough to feed a recording medium into the fixing apparatus 1 (Yes of Step S15), the delay compensation output is input into the input side of the calculator 32 (Step S16), and the recording medium is fed (Step 21).

When the target temperature is not changed (No of Step S13), the delay compensation output is input into the input side of the calculator 32 (Step S17), and after a predetermined waiting in a standby state (Step S18), the control returns to Step S13.

When the detected temperature with the temperature sensor 15 is not high enough to feed a recording medium into the fixing apparatus 1 (No of Step S15), the delay compensation output is not input into the input side of the calculator 32 (Step S19), and after predetermined waiting in a standby state (Step S20), the control returns to Step S15.

Figure 10:
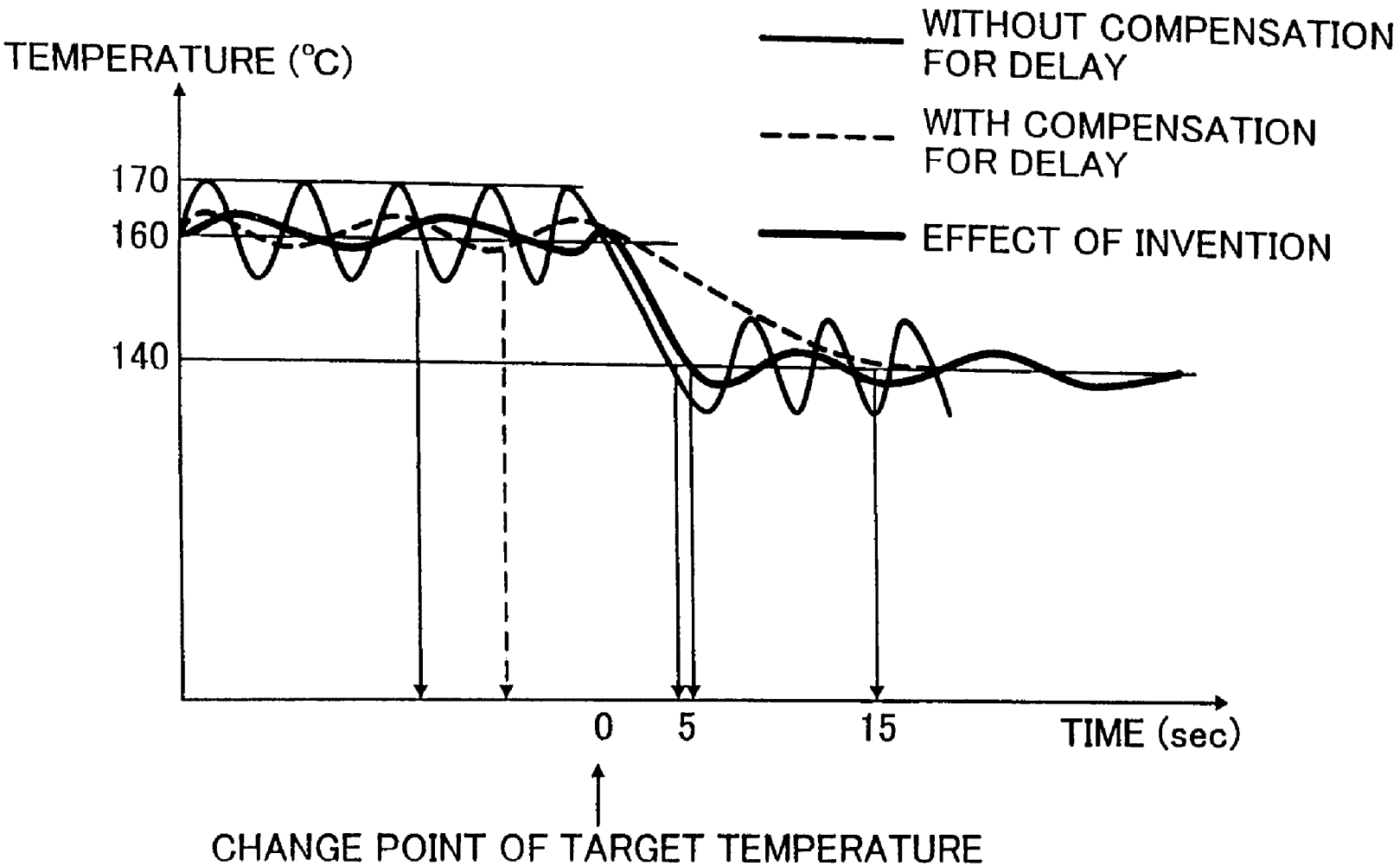
FIG. 10 is a graph showing different variations of a rising temperature of the rotating member through the temperature control procedure of FIG. 9.

Thereby, the temperature may quickly rise and fall to the target temperature. FIG. 10 is a graph showing a relation of the temperature of the rotating member 11 and time verifying the effect of this invention. As shown from FIG. 10, the target temperature is quickly attained and the temperature ripple may be reduced. Furthermore, when the speed of the recording medium through the nip between the rotating members 11 and 12 is changed, the delay compensation output may not be input into the input side of the calculator 32.

Figure 11:
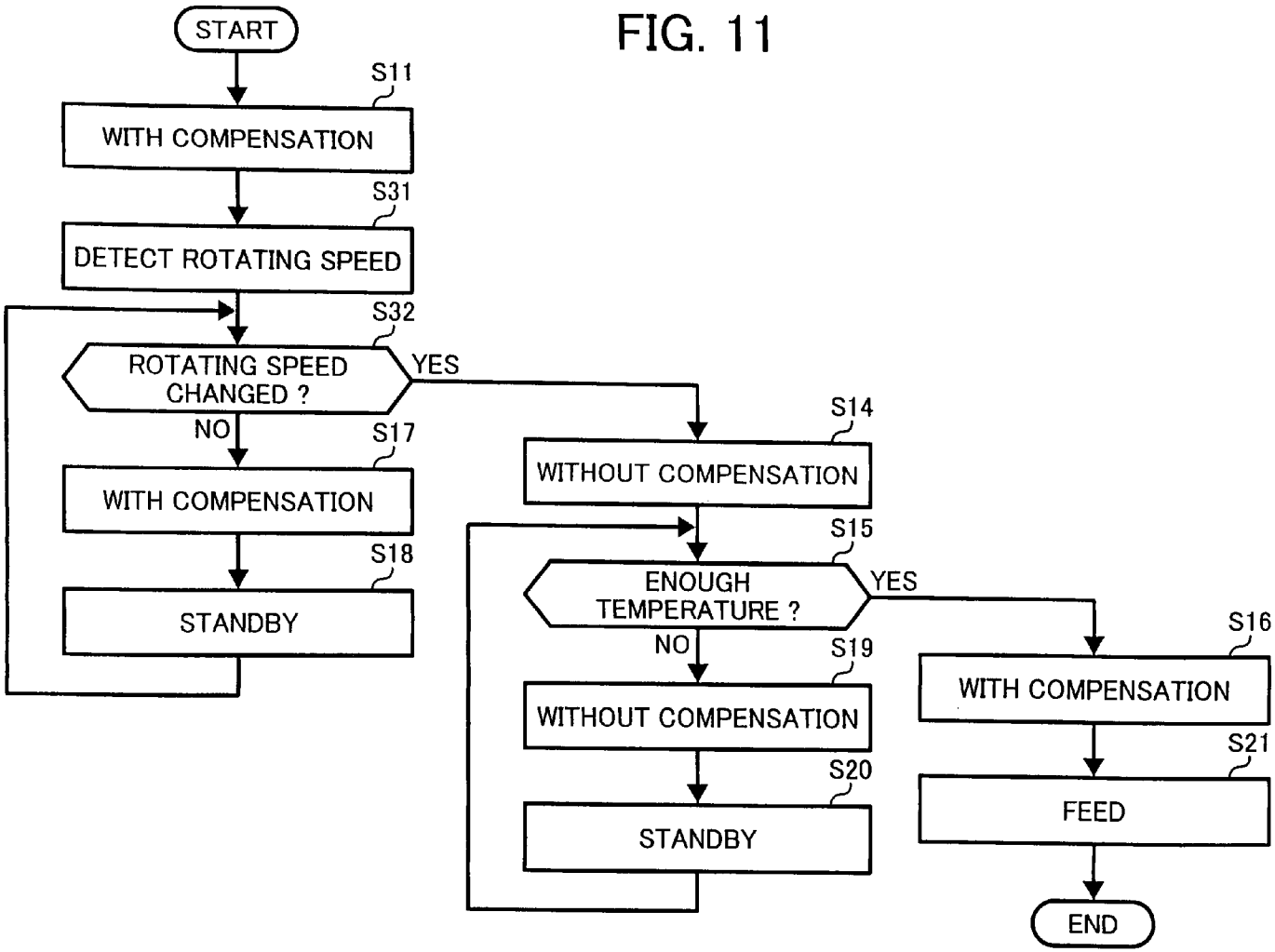
FIG. 11 illustrates a flowchart of a temperature control procedure performed by the control system of FIG. 6.

FIG. 11 illustrates a flowchart of the control system of FIG. 6 when the above compensation method is applied. The differences between FIG. 9 and FIG. 11 are Steps S31 and S32. Instead of detecting the temperature with the temperature sensor 15 (instead of Step S12), the rotating speed of the rotating members 11 and 12 is detected with a rotating sensor (not shown) (Step S31). Instead of judging whether the target temperature is changed (instead of Step S13), whether the rotating speed of the rotating members 11 and 12 is changed is judged (Step S32). Except for these operations in Steps S31, S32, the other controls are the same as those of FIG. 9. When changing the rotating speed of the rotating members 11 and 12, an overshoot or an undershoot of temperature may occur easily. With using the control of FIG. 1, the target temperature may be quickly attained for a rising or falling of temperature.

Figure 12:
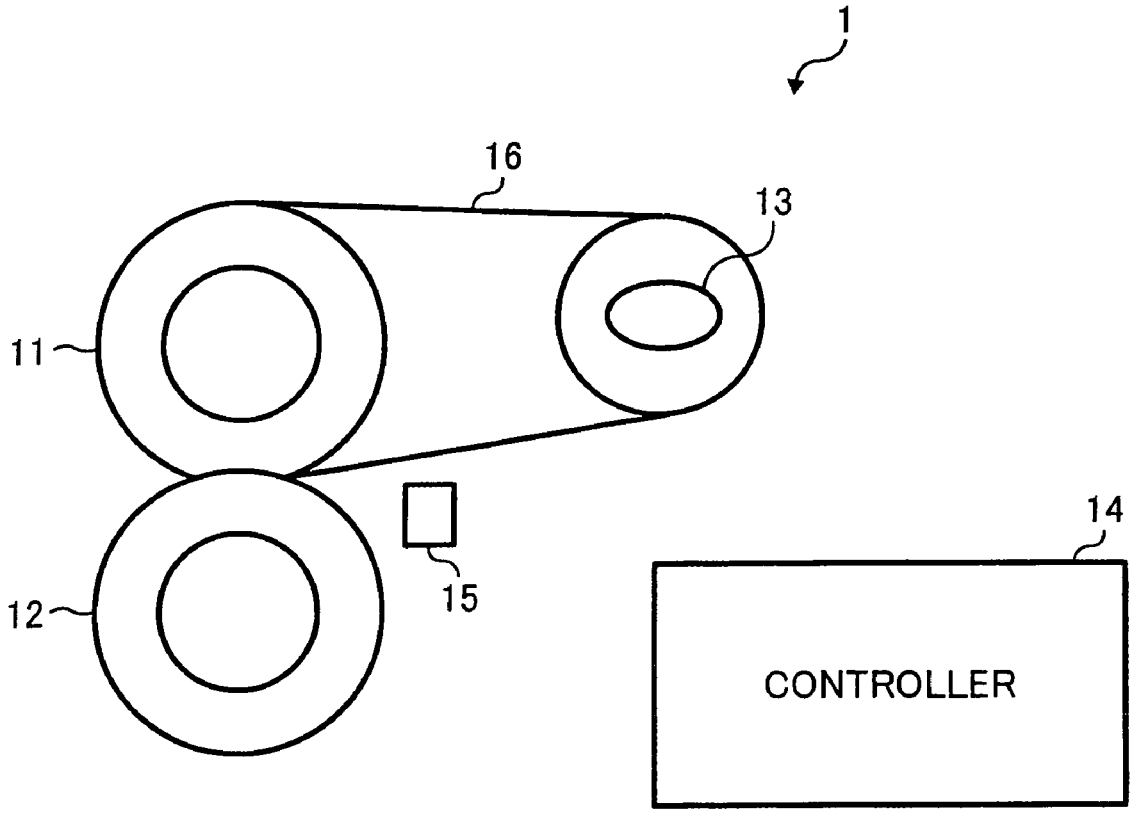
FIG. 12 is an illustration illustrating another image fixing apparatus according to an exemplary embodiment of the present invention.

FIG. 12 is an illustration illustrating a configuration of another embodiment of a fixing apparatus according to the present invention. The fixing apparatus uses a method of thermal belt fixing. A belt 16 transmits heat from a heater 13 to a rotating member 11. The same reference element numbers as in FIG. 1 indicate the same elements as in FIG. 1.

Figure 13:
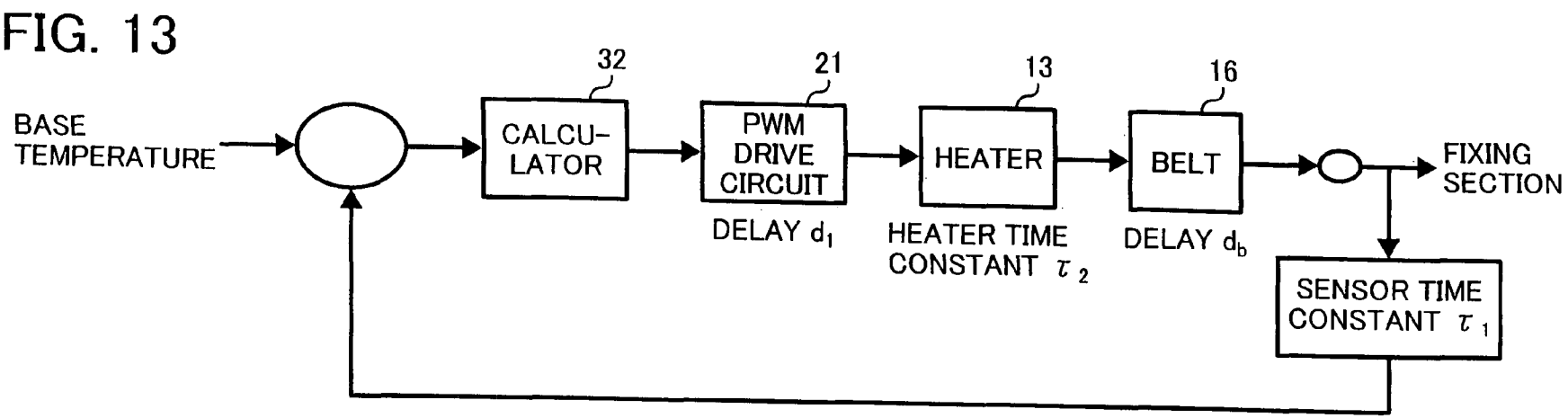
FIG. 13 is a block diagram of a control system of the image fixing apparatus illustrated in FIG. 12.

FIG. 13 is a block diagram of the control system of FIG. 12. Due to the heat transmission from the heater 13 to the belt 16, a delay db from the heater 13 to the sensor 15 occurs. That delay is longer than that of FIG. 1. In this system, a larger temperature ripple may occur, so it is difficult to keep temperature control accuracy. Therefore, the above mentioned control is applied to the fixing apparatus of FIG. 12.

Figure 14:
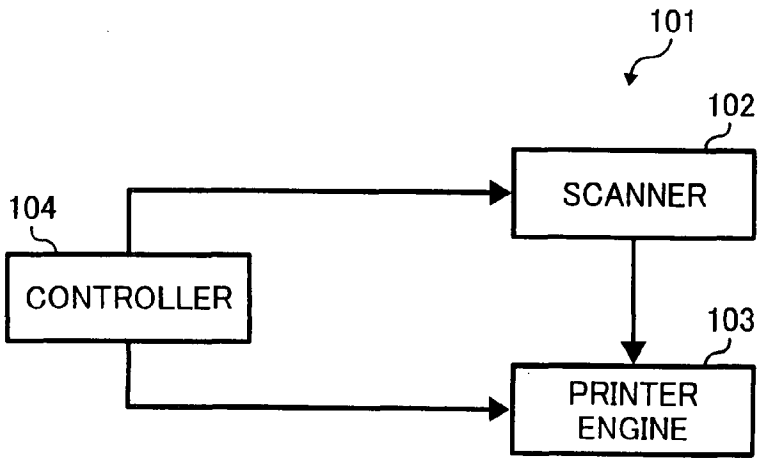
FIG. 14 is a block diagram illustrating an exemplary configuration of an image forming apparatus having the image fixing apparatus of FIG. 1.

FIG. 14 is a block diagram illustrating a configuration of an embodiment of an image forming apparatus according to the present invention. This image forming apparatus 101 is a digital copier. The image forming apparatus 101 includes a scanner 102 that reads the image of an original, a printer engine 103 that forms an image on a recording medium by an electronic photograph system based on the read image data, and a controller 104 that controls the whole image forming apparatus 101 intensively.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JPAP2005-262455 filed on Sep. 9, 2005, and No. JPAP2006-124682 filed on Apr. 28, 2006 in the Japan Patent Office, the entire contents of each of which are hereby incorporated by reference herein.

The invention claimed is:

1. An image fixing apparatus which fixes a toner image onto a recording medium, comprising:

a pair of rotating members to form a nip-press region through which the recording medium passes;

a heater to heat at least one of the pair of rotating members;

a temperature sensor to detect a temperature of the at least one of the pair of rotating members;

a calculator to calculate a heat value to increase a temperature of the at least one of the pair of rotating members to a target temperature based on a temperature detected by the temperature sensor;

a controller to control the heater based on a calculation result of the heat value output by the calculator;

a compensator to calculate and generate a delay compensation output by using a delay prediction model according to the calculation result of the calculator; and a selector to select one of a first condition in which the delay compensation output is entered into an input of the calculator and a second condition in which the delay compensation output is not entered into the input of the calculator, wherein the selector selects the first condition when continuously performing an image fixing operation on a plurality of the recording mediums continuously fed.

2. The image fixing apparatus of claim 1, wherein the selector selects the second condition when heating the at least one of the pair of rotating members up to the target temperature.

3. The image fixing apparatus of claim 1, wherein the selector selects the second condition when the target temperature of the at least one of the pair of rotating members is changed.

4. The image fixing apparatus of claim 1, wherein the selector selects the second condition when a speed of the recording medium at the nip-press region is changed.

5. The image fixing apparatus of claim 1, wherein the compensator includes a Smith predictor.

6. An image forming apparatus in electrophotographic process, comprising:

an image fixing apparatus that fixes a toner image onto an recording medium including:

a pair of rotating members to form a nip-press region through which the recording medium passes, a heater to heat at least one of the pair of rotating members, a temperature sensor to detect a temperature of the at least one of the pair of rotating members, a calculator to calculate a heat value to increase a temperature of the at least one of the pair of rotating members to a target temperature based on a temperature detected by the temperature sensor, a controller to control the heater based on a calculation result of the heat value output by the calculator, a compensator to calculate and generate a delay compensation output by using a delay prediction model according to the calculation result of the calculator, and a selector to select one of a first condition in which the delay compensation output is entered into an input of the calculator and a second condition in which the delay compensation output is not entered into the input of the calculator, wherein the selector selects the first condition when continuously performing an image fixing operation on a plurality of the recording mediums continuously fed.

7. The image forming apparatus of claim 6, wherein the selector selects the second condition when heating the at least one of the pair of rotating members up to the target temperature.

8. The image forming apparatus of claim 6, wherein the selector selects the second condition when the target temperature of the at least one of the pair of rotating members is changed.

9. The image forming apparatus of claim 6, wherein the selector selects the second condition when a speed of the recording medium at the nip-press region is changed.

10. The image forming apparatus of claim 6, wherein the compensator includes a Smith predictor.

11. An image fixing apparatus which fixes a toner image onto a recording medium, comprising:

means for forming a nip-press region through which the recording medium passes;

means for heating the nip-press region;

means for detecting a temperature of the means for forming;

means for calculating a heat value to increase a temperature of the means for heating to a target temperature based on a temperature detected by the means for detecting;

means for controlling the means for heating based on a calculation result of the heat value output by the means for calculating;

means for compensating by calculating and generating a delay compensation output by using a delay prediction model according to the calculation result of the means for calculating; and means for selecting one of a first condition in which the delay compensation output is entered into an input of the means for calculating and a second condition in which the delay compensation output is not entered into the input of the means for calculating, wherein the means for selecting selects the first condition when continuously performing an image fixing operation on a plurality of the recording mediums continuously fed.

12. The image fixing apparatus of claim 11, wherein the means for selecting selects the second condition when heating the at least one of the pair of rotating members up to the target temperature.

13. The image fixing apparatus of claim 11, wherein the means for selecting selects the second condition when the target temperature of the at least one of the pair of rotating members is changed.

14. The image fixing apparatus of claim 11, wherein the means for selecting selects the second condition when a speed of the recording medium at the nip-press region is changed.

15. The image fixing apparatus of claim 11, wherein the means for compensating includes a Smith predictor.

* * * * *